US007815332B1

(12) United States Patent
Smith

(10) Patent No.: US 7,815,332 B1
(45) Date of Patent: Oct. 19, 2010

(54) LIGHTING APPARATUS AND ASSOCIATED METHOD

(76) Inventor: Dustin Smith, 15214 Brown Eyed Susan Ct., Cypress, TX (US) 77433

( * ) Notice: Subject to any disclaimer, the term of this patent is extended or adjusted under 35 U.S.C. 154(b) by 62 days.

(21) Appl. No.: 12/008,451

(22) Filed: Jan. 11, 2008

Related U.S. Application Data

(63) Continuation-in-part of application No. 11/344,669, filed on Feb. 1, 2006, now abandoned.

(51) Int. Cl.
*F21V 21/00* (2006.01)

(52) U.S. Cl. ..... 362/133; 362/147; 362/227; 362/235; 362/20

(58) Field of Classification Search ..... 362/247, 362/133, 147, 148, 227, 20, 225, 235, 221, 362/216, 219, 260, 226, 391; 174/50
See application file for complete search history.

(56) References Cited

U.S. PATENT DOCUMENTS 5,640,069 A 6/1997 Nilssen
D406,916 S 3/1999 Klaus
D411,324 S 6/1999 Roorda
D411,325 S 6/1999 Roorda
D411,326 S 6/1999 Roorda
D440,692 S 4/2001 Janos et al.
D443,713 S 6/2001 Benensohn
6,390,652 B1 * 5/2002 Echito ..... 362/374
6,431,722 B1 8/2002 Benensohn
6,508,566 B1 1/2003 Roorda
6,536,924 B2 * 3/2003 Segretto ..... 362/345
6,814,462 B1 11/2004 Flene
2008/0037239 A1 * 2/2008 Thomas et al. ..... 362/92

* cited by examiner

*Primary Examiner*—Anabel M Ton
(74) *Attorney, Agent, or Firm*—Montgomery Patent and Design; Robert C. Montgomery

(57) ABSTRACT

The present invention comprises a novel lighting panel and outlet strip suitable for mounting underneath cabinetry or similar locations of low clearances or limited natural illumination. The panel has an illuminating assembly housed within a transparent or translucent cover as well as an outlet strip for electrical appliances, most preferably consisting of a Ground Fault Interrupter (GFI) electrical outlet.

8 Claims, 5 Drawing Sheets

LIGHTING APPARATUS AND ASSOCIATED METHOD

RELATED APPLICATIONS

The present invention is a continuation-in-part of and claims the benefit of U.S. application Ser. No. 11/344,669, filed Feb. 1, 2006 now abandoned, the entire disclosures of which are incorporated herein by reference.

FIELD OF THE INVENTION

The present invention relates to lighting apparatus and more particularly to lighting panels and outlet strips suitable for mounting underneath cabinetry or locations of low clearance and/or limited natural illumination.

BACKGROUND OF THE INVENTION

Normal lights and lighting arrangement within a room or housing do not adequately meet the requirement of lighting underneath cabinetry or locations of low clearance and/or limited natural illumination. Generally, the conventional light devices are used and mountable only in open larger areas and consume a lot of power. As such the requirement of lighting arrangement in locations of limited natural illumination has increased in the recent past. The conventional lighting devices and arrangements are not useful for mounting in locations of low clearance and/or limited natural illumination, due to their bulky structure and complex configuration and operational indices. Also, there exists a need for home interior designs within kitchens or bathrooms to eliminate unsightly electrical sockets on the backsplash and tiled walls. Such arrangements need to meet the space constraints and at the same time should be capable of saving power in terms of portability and ease of installation as well as providing additional freedom and variability in interior decoration.

Several attempts have been made in the past to provide lighting arrangements for mounting underneath cabinetry or locations of low clearance and/or limited natural illumination. For Example, U.S. Pat. No. 6,814,462 provides a low cost under-cabinet and display case lighting system that permits the highest degree of flexibility in the installation and location of luminaires for under-cabinet and display case lighting. The system consists of a high-frequency power source, an interconnection cord, and one or more high-frequency luminaires. The interconnection cord is connected to the high-frequency output of a high-frequency power source. The high-frequency luminaires are mounted in the desired locations under the cabinets or display case shelves. The interconnecting cord is then routed to each of the high-frequency luminaires and placed over the input terminals. This device has complex structure and is not convenient in operation.

U.S. Pat. No. 6,431,722 provides an under-cabinet lighting fixture for permanent mounting having housing suitable for recess or surface mounting and connected by a stem to a junction box mounted to an upper surface for electrical wiring connections. The stem defines a passageway for the electrical wiring to route from the housing to the junction box. This device also has complex structure and is not convenient in removably using the same in various applications.

None of the prior art particularly describe a lighting apparatus suitable for mounting underneath cabinetry or locations of low clearances or limited natural illumination that is simple in configuration and provides an easy installation. Accordingly, there is a need for a lighting apparatus suitable for mounting underneath cabinetry or locations of low clearance and/or limited natural illumination, in a fast, easy, consistent, reliable, and efficient manner.

SUMMARY OF THE INVENTION

The lighting apparatus, in an alternative embodiment presents a combination lighting apparatus comprising a light unit, an outlet unit, a linking cord and a power cord.

The combination lighting apparatus possesses a configurable arrangement of one (1) or more light units and one (1) or more outlet units either separately or in combination.

The combination lighting apparatus light and outlet units are electrically connected to each other via a linking cord and the power cord.

The combination lighting apparatus linking and power cords possess a shrouded female plug and a common male plug at the opposing end of the cord.

The combination lighting apparatus linking cord is comprised of insulated conductor of sufficient length to provide a connection between adjacent combined light and outlet units.

The combination lighting apparatus power cord comprises similar construction as the linking cord and is of longer length than the linking cord further providing for either hardwiring into a junction box or equipped with a plug for insertion into an existing electrical outlet.

The combination lighting apparatus light and outlet units comprise a second housing and third housing in a variety of lengths suitable to a variety of installations.

The combination lighting apparatus housings comprise rectangular enclosures with a pair of posts, a pair of sockets, a pair of mounting ears, a shrouded male receptacle and a female receptacle.

The combination lighting apparatus housing posts and sockets are integrally molded features within the second and third housings.

The combination lighting apparatus possesses mounting ears are comprised of a hole through an ear attached to the lighting or outlet units that permit the mechanical attachment of the apparatus in a desired location.

The combination lighting apparatus lighting or outlet units possess a shrouded male receptacle and the female receptacle located along opposing end panels of the second and third housings and permit the continuation of electrical power to subsequent units.

The combination lighting apparatus lighting unit possesses an internal illuminating device is controlled by a second ON/OFF switch that may be of any commercially available type such as, but not limited to: a rocker, toggle, or pushbutton switch.

The combination lighting apparatus outlet unit may possess a GFCI outlet.

The combination lighting apparatus provides for polarity of AC power between units by using common male and female electrical fixtures as well as shrouded male and female electrical fixtures.

The combination lighting apparatus provides a fast, easy and convenient means to provide lighting and/or electrical outlets in locations where this desired.

The prior art appears to disclose lighting apparatuses that can be mounted in under-cabinet locations. The prior art does not appear to disclose a combination lighting apparatus with lighting and outlet units capable of rapid, easy installation and connectable in series in varied combinations to accommodate varied desired lighting and electrical needs.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 4*b* is a close-up view of a receptacle portion 67 of a combination embodiment 55, according to an alternate embodiment of the present invention; and, FIG. 5 is a schematic diagram of a combination embodiment 55 of the apparatus 10, according to an alternate embodiment of the present invention.

DESCRIPTIVE KEY

Figure 1:
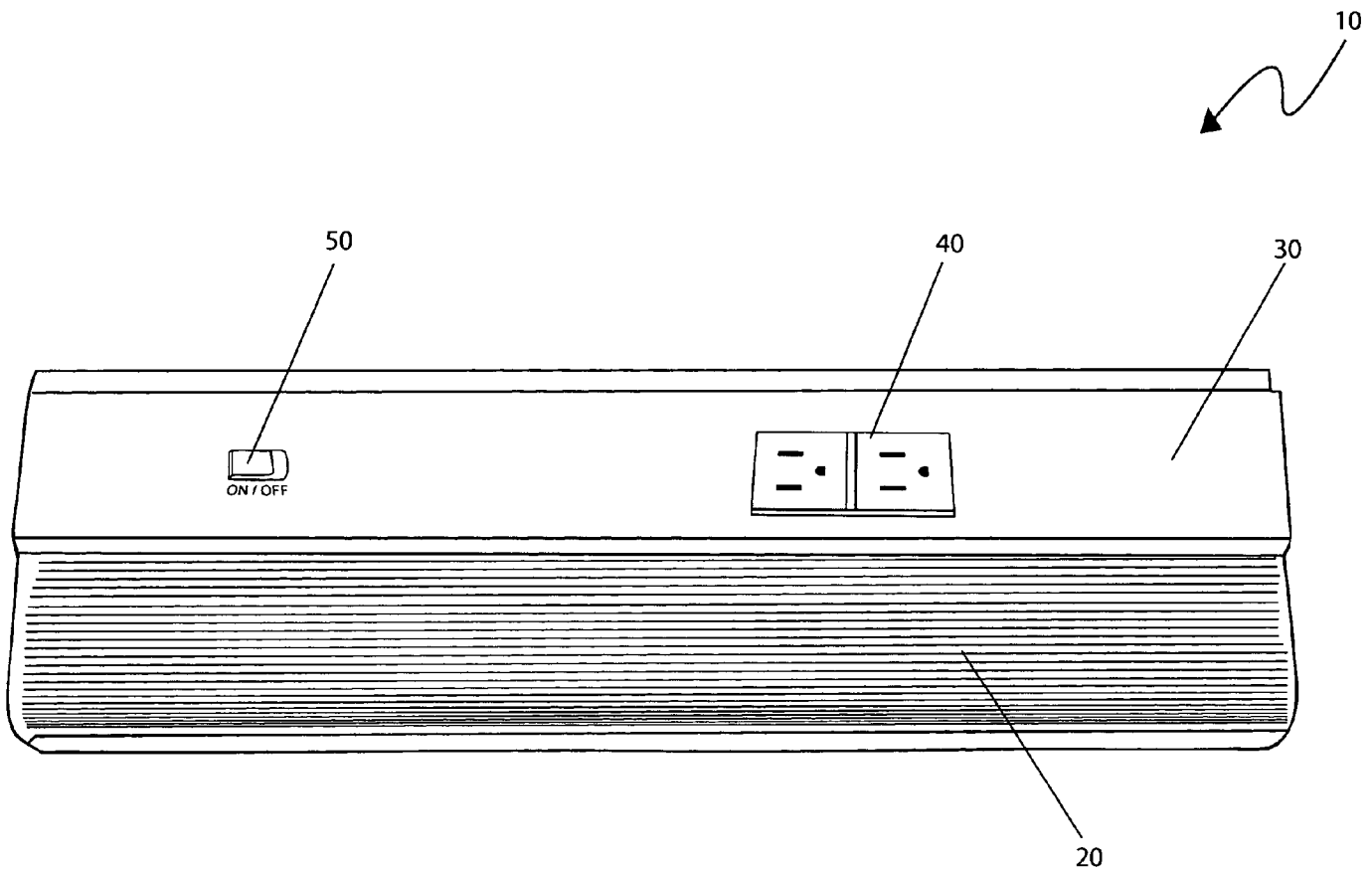
FIG. 1 is a perspective view of an under cabinet light and outlet strip 10, according to a preferred embodiment of the present invention.

10 under cabinet light and outlet strip
20 first cover
30 first housing
40 outlet strip
50 first ON/OFF switch
55 combination embodiment
60 light unit
61 second housing
62 second cover
64 mounting ear
65 shrouded male receptacle
66 post
67 female receptacle
68 second ON/OFF switch
70 outlet unit
71 duplex outlet
72 ground fault circuit interrupt (GFCI) outlet
73 third housing
74 socket
80 linking cord
81 power cord
82 shrouded female plug
83 male plug

DETAILED DESCRIPTION OF THE PREFERRED EMBODIMENT

Figure 2:
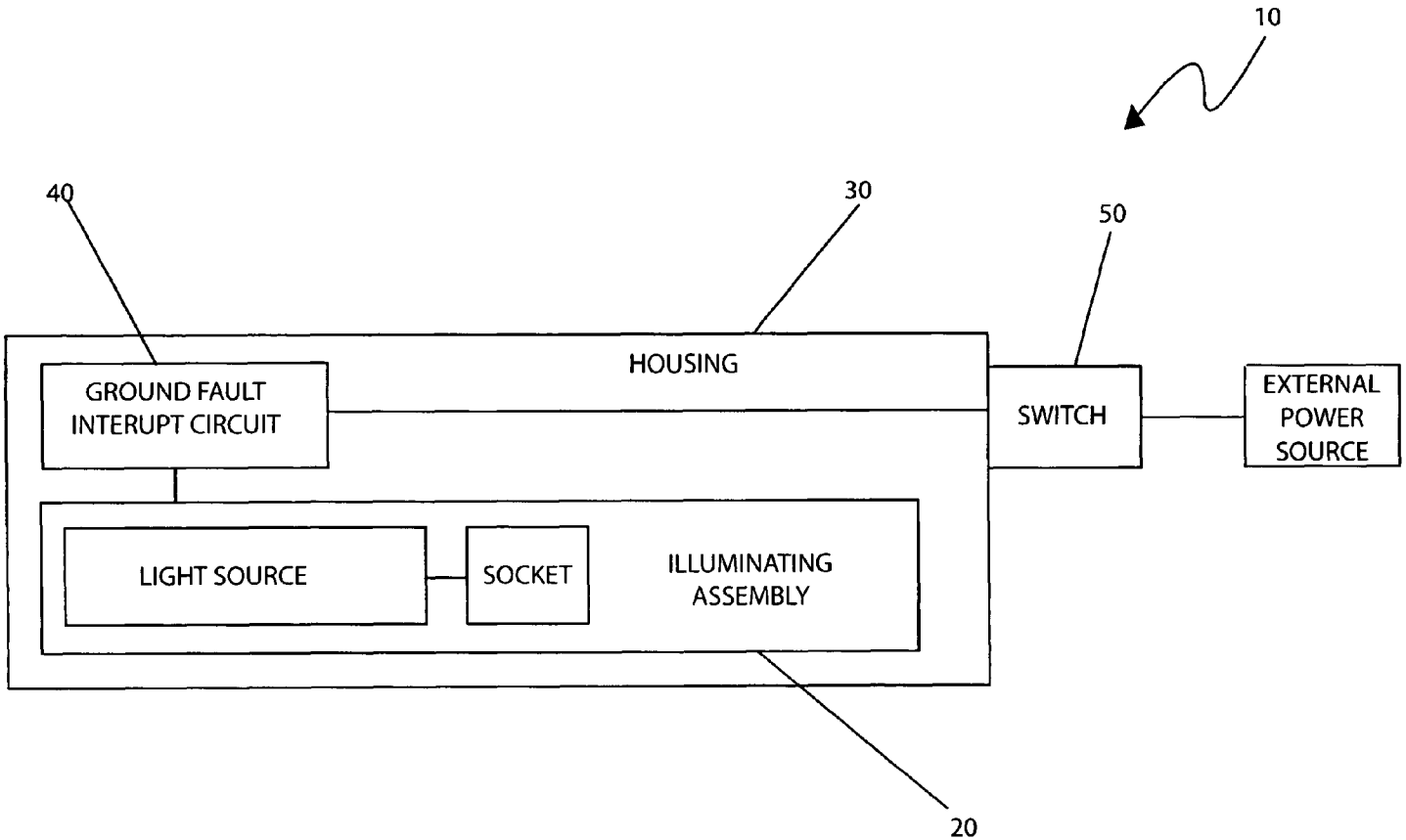
FIG. 2 is a schematic diagram showing the interrelationship of the present invention's components, according to a preferred embodiment of the present invention.
Figure 3:
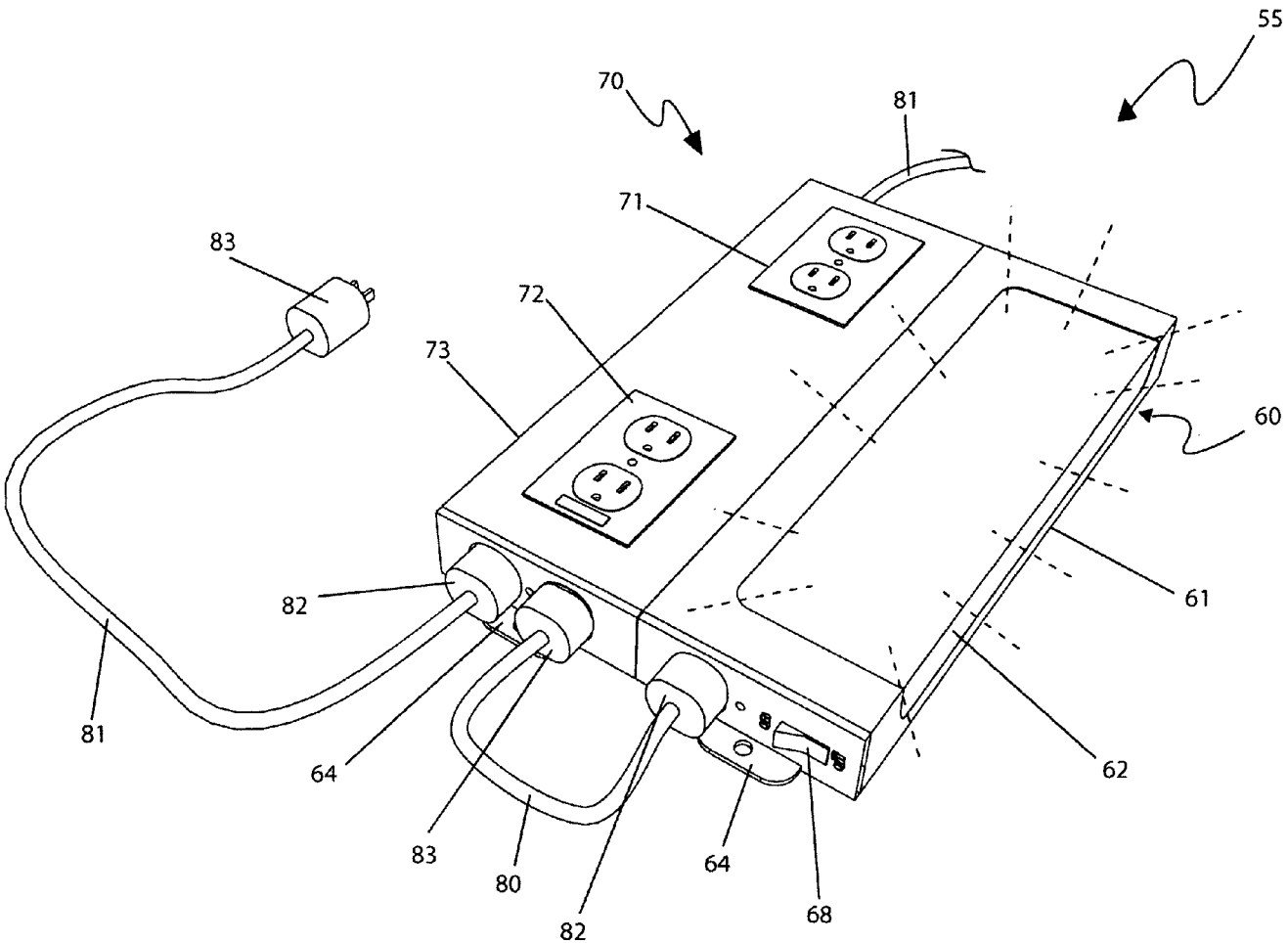
FIG. 3 is a perspective view of a combination embodiment 55 of an under cabinet light and outlet strip 10, according to an alternate embodiment of the present invention.
Figure 4A:
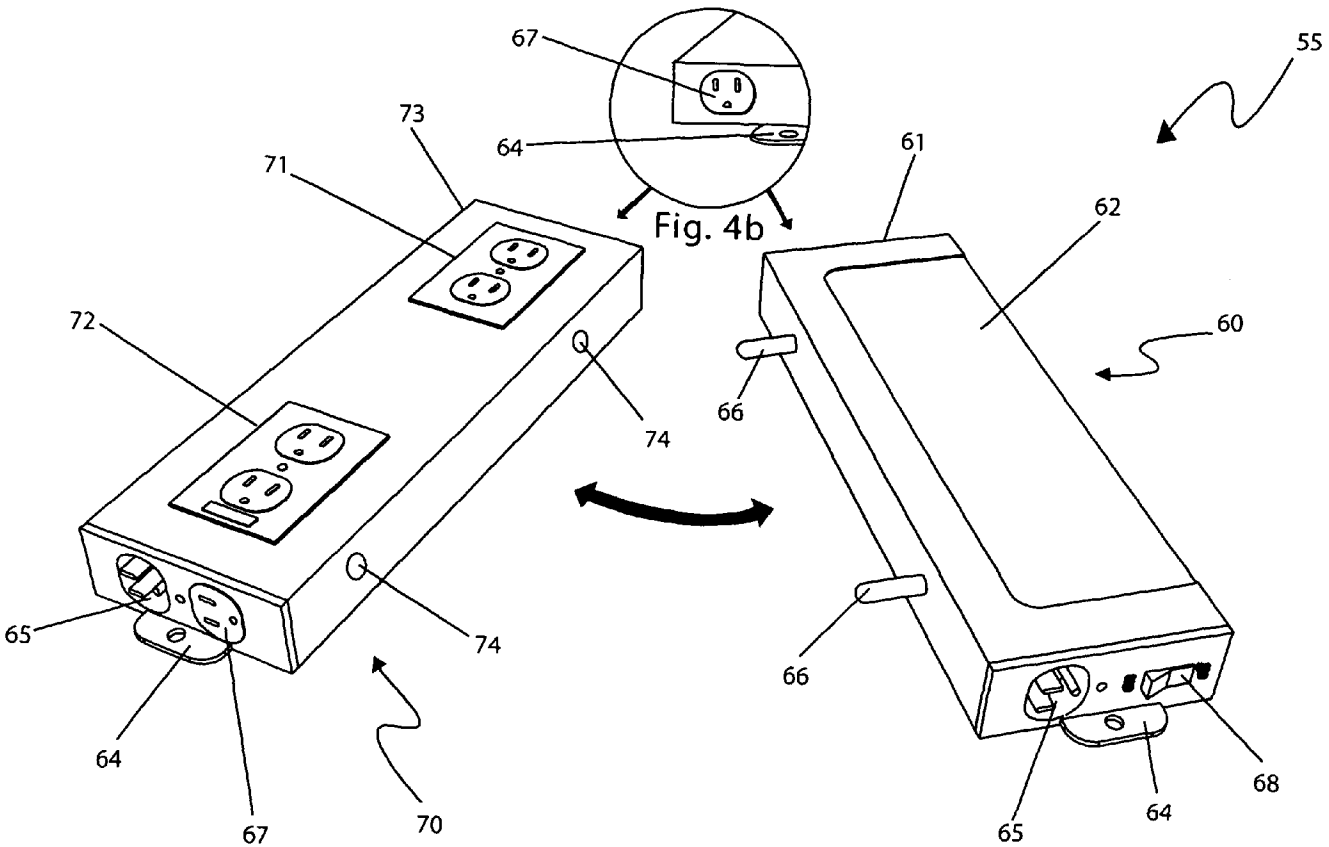
FIG. 4*a* is an exploded view of a combination embodiment 55, according to an alternate embodiment of the present invention.
Figure 5:
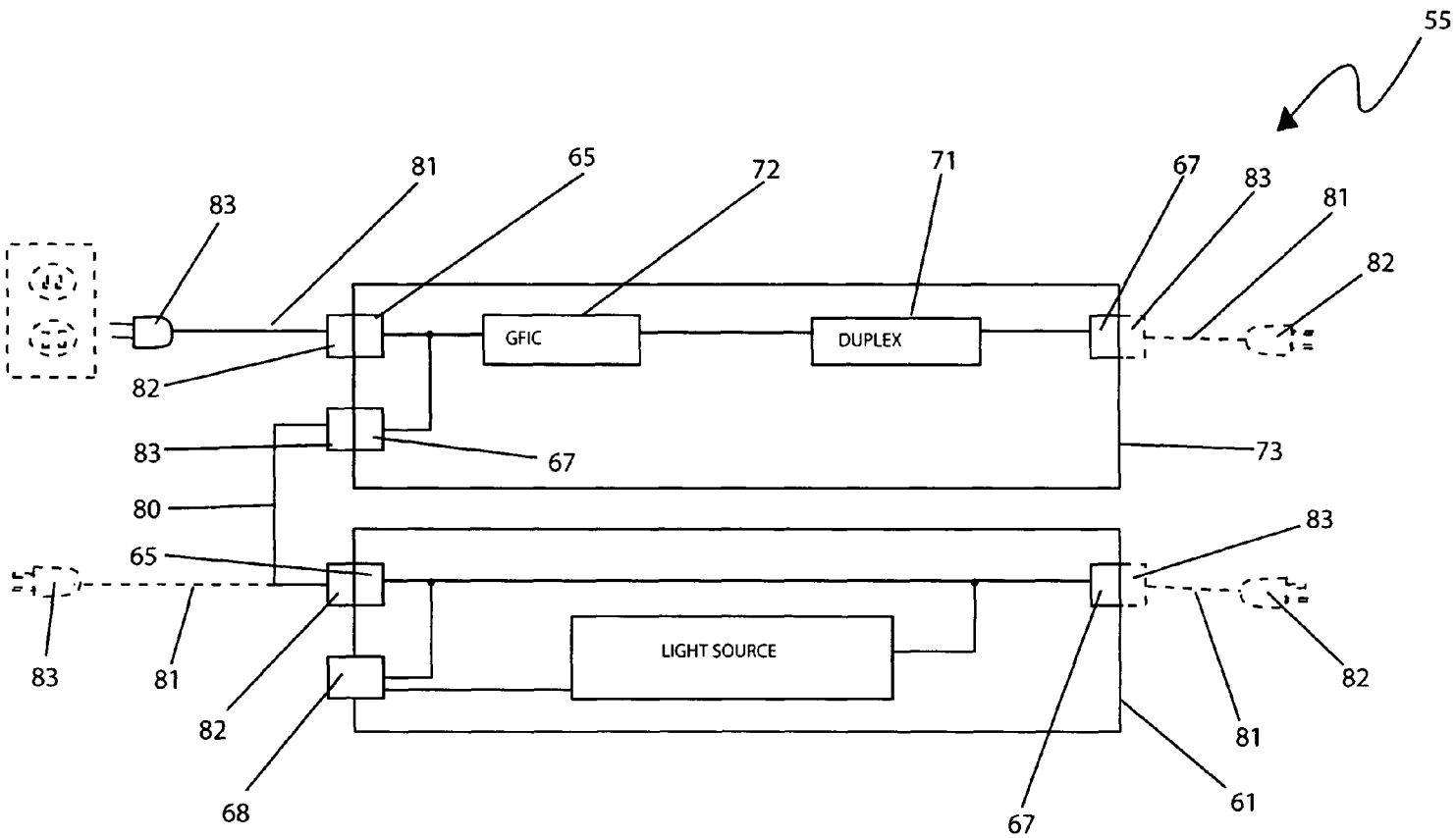

The best mode for carrying out the invention is presented in terms of its preferred embodiment, herein depicted within FIGS. 1 and 2, and depicted in an alternate embodiment in FIGS. 3 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an under cabinet light and outlet strip (herein described as the "apparatus") 10, which provides a means for an under-cabinet light fixture. Such under-cabinet light fixtures have a light source that eliminates shadows and provides light of sufficient intensity to effectively perform tasks in a working area. The lighting apparatus can be used in under kitchen cabinets, in museum display cabinets, in trade show exhibits, on office desk tops, at hospital work stations, in bookcases in studies or libraries, in display cases in restaurants, under tavern shelves or under bars, in bathroom linen closets, within bedroom shelving, in wall nooks along hallways or stairways, in dining room hutches, in living room shelving, family room entertainment centers, and similar working areas.

The lighting apparatus has a size, shape and configuration, such that, the lighting apparatus may be easily mounted underneath cabinetry or similar locations of low clearances and/or limited natural illumination.

Referring now to FIG. 1, a perspective view of the apparatus 10, according to the preferred embodiment of the present invention, is disclosed. The apparatus 10 comprises a first housing 30, an illuminating assembly (not shown) for removably receiving a light source, a first cover 20, and an outlet strip 40.

The first housing 30 can have an open end and an opposite end, configuring an interior space therebetween. The first housing 30 can be made of any suitable material that can withstand elevated temperature conditions associated with under-cabinet light fixtures, and also providing sufficient structural integrity to the lighting apparatus 10. Suitable materials include: moldable thermoplastic materials, such as, polyolefins, polyesters, polyamides, polycarbonates, polyurethanes, polyvinylchloride, polytetrafluoroethylene, polystyrene, polyethylene terephathalate, and copolymers and blends thereof; and other equivalent resilient fabrication materials. Alternatively, the first housing 30 may be made of sheet metal, such as, cold rolled steel, and the like.

The illuminating assembly is disposed in the interior space in the first housing 30. The illuminating assembly comprises structural features, for example, sockets that are capable of removably receiving at least one light source. Suitable light sources include, but are not limited to, xenon light sources, halogen light sources, and fluorescent light sources. The illuminating assembly further comprises a reflector with a reflective surface for reflecting light emitted by the light source onto the working area i.e., the area wherein the light is intended to be focused on.

The first cover 20 is disposed on a portion of the first housing 30, in such a way that the first cover 20 covers the illuminating assembly at a side from which light emitted by the light source is illuminating the working area. In one embodiment, the first cover 20 is disposed on a portion of the open end of the first housing 30. The first cover 20 is made of a material that allows at least a partial transmission of light from the light source. Based on the required intensity of light at the working area, the first cover 20 can be made of transparent or translucent glass or plastic (tempered), or other equivalent materials ranging from clear to colored materials. Also, the first cover 20 can be designed as a decorative cover to provide an aesthetically pleasing look.

The first housing 30 further accommodates various electrical connection means that provide electrical current to the illuminating assembly, i.e., for providing electrical current to the light sources. The outlet strip 40 has an electrical interface, for example, an electrical socket 40, an electrical plug, or the like, for electrically connecting the lighting apparatus 10 to an outside electrical power supply. In one embodiment, the outlet strip 40 is a ground fault circuit interrupter (GFCI), that offers personal protection against electrical shock and can be installed in areas where known electrical shock hazards exist, for example, outdoor outlets and fixtures, swimming pools, saunas and hot tubs, outlets in kitchens, basements, bathrooms, garages and the like. Alternatively, the lighting apparatus 10 may be hardwired to a building's electrical system or equipped with an electrical cord for use with a conventional electrical socket. Also, decorative plugs and sockets may be used for serving as the electrical interface.

Further, the lighting apparatus 10 can comprise a first ON/OFF switch 50 for switching on/off the lighting apparatus 10, i.e., for providing a control means to control the electrical power reaching the illuminating assembly. Preferably, the first ON/OFF switch 50 is disposed on the outlet strip 40, at a position that can be easily accessed by the user for switching on/off the lighting apparatus 10.

The lighting apparatus 10 has structural features to mount the lighting apparatus 10 underneath a cabinet, storage structure or similar location having inaccessibility to electrical power and has minimal lighting requirement. In one embodiment, the lighting apparatus 10 has a mounting mechanism configured to mount the lighting apparatus 10 on a working area surface having a complementary mounting mechanism. For example, the lighting apparatus 10 has a first pair of through holes that aligns with a second pair of through holes on the working area surface, and by passing fasteners (e.g., bolts, nuts, screws, and the like) through the first pair of through holes and the second pair through holes.

Referring now to FIG. 2, a schematic diagram of the apparatus 10, according to the preferred embodiment of the present invention, is disclosed. An external 110-volt alternating current (AC) power source is routed therethrough a common panel mounted first ON/OFF switch 50 to an internal GFCI outlet 40 and onto an illuminating assembly comprising a light source and a duplex outlet.

Referring now to FIG. 3, a perspective view of a combination embodiment 55 configuration of the apparatus 10, according to an alternate embodiment of the present invention, is disclosed. The combination embodiment 55 comprises a light unit 60, an outlet unit 70, a linking cord 80, and a power cord 81. The combination embodiment 55 provides a configurable arrangement of one (1) or more light units 60 and one (1) or more outlet units 70 either separately or in combination. Said light 60 and outlet 70 units may be electrically connected in pairs or as individual units 60, 70 based upon a user's preference via the linking 80 and power 81 cords. Additionally, a pair of light 60 and outlet 70 units may be connected mechanically to form a single rectangular-shaped assembly via molded-in post 66 and socket 74 features, respectively (see FIG. 4). Any number of light 60 and outlet 70 units may be arranged in a room being grouped in combination or arranged individually in series.

The linking cord 80 and the power cord 81 provide polarized electrical connections between units 60, 70 providing 110-volt power thereto. Each cord 80, 81 provides a shrouded female plug 82 and a common male plug 83 at an opposing end thereon being similar in construction to those used on computer equipment. The linking cord 80 is envisioned to be an insulated conductor approximately eight (8) inches long providing a connection between adjacent combined light 60 and outlet 70 units when arranged as shown here. The power cord 81 comprises similar construction as the linking cord 80; however, it is envisioned to be introduced in a variety of lengths approximately one (1) to three (3) feet long providing an electrical connection therebetween individual light 60 or outlet 70 units. Although depicted here in a combination embodiment 55, it is understood that said power cord 81 may provide electrical connection therebetween any number or sequence of light 60 and/or outlet 70 units with equal benefit when said units 60, 70 are arranged in a series configuration within a room. Additionally, said power cord 80 may provide a hard-wiring means thereto an existing electrical junction box in a conventional manner to establish connection thereto an existing power source.

Referring now to FIGS. 4*a* and 4*b*, an exploded view and a close-up view of a combination embodiment 55 of the apparatus 10, according to an alternate embodiment of the present invention, is disclosed. The light 60 and outlet 70 units are depicted here as individual units providing expanded configuration possibilities.

The light 60 and outlet 70 units comprise a second housing 61 and third housing 73, respectively. Said housings 61, 73 are envisioned to be introduced in a variety of lengths being suitable to a variety of installations. The housings 61, 73 comprise similar rectangular enclosures to that of the preferred embodiment 10 with added enhancements including a pair of posts 66, a pair of sockets 74, a pair of mounting ears 64, a shrouded male receptacle 65, and a female receptacle 67. The light 60 and outlet 70 units comprise a pair of posts 66 and a pair of sockets 74, respectively. The posts 66 comprise a male appendage envisioned to be approximately one (1) inch long having a round-nose shape providing a mating means between a light unit 60 and an outlet unit 70. The posts 66 further comprise a particular diameter, location and length so as to fully engage the complimenting socket portions 74 of the outlet unit 70. The posts 66 and sockets 74 are located along common adjacent side panels of the second 61 and third 73 housings, respectively. The posts 66 and sockets 74 are envisioned to be integrally molded features therewithin said second 61 and third 73 housings. The mounting ears 64 provide a means to mount the light unit 60 thereto flat surfaces as previously described for the preferred embodiment 10 without a need for disassembly of the second housing 61. The mounting ears 64 are envisioned to extend in a coplanar fashion therefrom a bottom panel portion of said housings 61, 73. The mounting ears 64 are envisioned to comprise a through hole that aligns with a second pair of pre-drilled through holes on a working area surface being attached thereto by passing fasteners such as bolts, nuts, screws, and the like, therethrough said holes. The shrouded male receptacle 65 and the female receptacle 67 are located along opposing end panels of the second 61 and third 73 housings. The shrouded male receptacle 65 receives 110-volt AC power via connection therefrom the aforementioned shrouded female plug portion 82 of the linking 80 and power 81 cords. Continuation of said 110-volt AC power to subsequent units 60, 70 is accomplished by connecting the male plug portion 83 of additional power cords 81 thereto the female receptacle 67 at an opposing end of said units 60, 70.

The light unit 60 further comprises an internal illuminating device and a second cover 62 comprising similar materials and construction as the illuminating device and first cover portions 20 of the preferred embodiment previously described in FIG. 1. The light unit 60 also comprises a second ON/OFF switch 68. The second ON/OFF switch 68 is envisioned to be a commercially available switch such as a rocker, toggle, pushbutton, or the like. Said second ON/OFF switch 68 is depicted here being located along an end surface of the second housing 61; however, said second switch 68 may be provided along any exterior surface of said second housing 61 with equal convenience and as such should not be interpreted as a limiting factor of the present invention 10.

The outlet unit 70 as shown here, provides an electrical distribution means comprising a single GFCI outlet 72 and a single common duplex outlet 71 being mounted thereto a top surface of the third housing 73 in an expected manner; however, it is understood that various combinations of said outlets 71, 72 may be provided based upon particular electrical requirements and configurations including one (1) or more of each type outlet 71, 72. It is further understood that a single GFIC outlet 72 may provide a primary safety switch means to a plurality of subsequent outlet units 70 being wired electrically in series, thereby providing joint ground fault protection thereto.

Now referring to FIG. 5, a schematic diagram of a combination embodiment 55 of the apparatus 10, according to an alternate embodiment of the present invention, is disclosed. It is understood that any number of light 60 and outlet 70 units may be arranged in a variety of configurations using the linking 80 and power 81 cords; however, a typical combination of a single light unit 60 and a single outlet unit 70 is depicted here for simplicity sake and as such should not be interpreted as a limiting factor of the present invention 10. Electrical power received from a common household circuit is conducted via a power cord 81 externally thereto an outlet unit 70. Said 110-volt power is in turn conducted internally thereinto the third housing portion 73 of the outlet unit 70 to a GFIC outlet 72 and a common duplex outlet 71; however, it is also understood that any combination of said GFIC outlets 72 and duplex outlets 71 may be used to configure the outlet unit 70 and as such should not be interpreted as a limiting factor of the present invention 10. Power is also routed in a parallel manner thereto a combination light unit 60 via a linking cord 80. Power is then conducted internally therein the light unit 60 through the second ON/OFF switch 68 providing a controlled electrical current thereto a light source located therein the second housing portion 61 of the light unit 60. Various additional power cords 81 are shown here in dashed lines depicting possible expansion of the combination embodiment 55. Polarity of AC power between units 60, 70 is maintained using common male 83 and female 67 electrical fixtures as well as shrouded male 82 and female 83 electrical fixtures similar to those used on computer equipment.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1 or as alternately depicted in FIG. 3.

The method of installing and utilizing the apparatus 10 may be achieved by performing the following steps: determining particular quantities and lengths of the apparatus 10 needed to complete an installation; purchasing said units 10; mounting said units 10 using common fasteners; interconnecting mounted units 10 using common wiring; determining a location of an existing 110-volt power source; de-energizing said existing AC power source for safety sake; connecting the first unit 10 thereto said power source via an existing electrical box; energizing said existing AC power source; utilizing the installed light units 10 using the first ON/OFF switches 50 as needed; utilizing the apparatus 10 in an expected manner to provide power to various appliances and equipment; and, benefiting from quick installation, increased convenience, and safety afforded the user of the invention 10.

The method of installing and utilizing the alternate combination embodiment 55 may be achieved by performing the following steps: determining particular quantities and lengths of light 60 and outlet 70 units needed to complete an installation; purchasing said units 60, 70; joining any light units 60 and outlet units 70, being used in combination, by inserting the post 66 and socket 74 features thereupon each unit 60, 70; mounting said units 60, 70 and/or combinations of said units 60, 70 using the mounting ears 64 and common fasteners; interconnecting mounted units 60, 70 using linking 80 and power 81 cords; connecting said units 60, 70 to an existing power source as described above; energizing said existing AC power source; utilizing the installed light units 60 using the second ON/OFF switches 68 to illuminate an area as needed; utilizing the outlet units 70 using the GFIC outlets 72 and duplex outlets 71 in an expected manner to provide power to various appliances and equipment. During an installation of the preferred or alternate embodiments of the invention 10, minimizing a number of GFIC outlet units 72 used may be possible by wiring a single GFIC outlet 72 in series with subsequent units 70, thereby acting jointly as a primary safety switch.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An under-cabinet light and outlet strip for illuminating a surface area disposed below a cabinet, said under-cabinet light and outlet strip comprising:

a portable light unit having a light source housed therein;

a portable outlet unit removably conjoined directly to said light unit in such a manner that respective adjacent side panels of said light and outlet units are contiguously and linearly engaged;

first and second male receptacles located along end panels of said light and outlet units respectively;

a female receptacle located along said end panel of said outlet unit and positioned adjacent to said first male receptacle respectively;

a ground fault interrupt circuit electrically coupled in series to said second male receptacle and said female receptacle of said outlet unit respectively;

a linking cord having opposed male and female plugs removably and electrically coupled directly to said female receptacle of said outlet unit and said first male receptacle respectively;

a power cord having a female plug directly and removably coupled to said second male receptacle and further having a male plug removably attachable to an external power supply source;

a duplex outlet mounted to a top surface of said outlet unit and electrically coupled directly to said ground fault interrupt circuit; and, a switch mounted to said light unit and being electrically coupled directly to said first male receptacle and said light source respectively;

wherein said second male receptacle is electrically coupled to said female receptacle and said ground fault interrupt circuit respectively; and, wherein said light and outlet units comprise: a plurality of posts and a plurality of sockets directly and removably engaged in such a manner that respective top surfaces and end panels of said light and outlet units remain contiguously abutted in coplanar orientations respectively.

2. The under-cabinet light and outlet strip of claim 1, wherein said posts are coextensively and linearly shaped and are further provided with rounded distal noses, said posts being registered orthogonal to said side panel of said light unit and being linearly interfitted within said sockets.

3. The under-cabinet light and outlet strip of claim 2, wherein said posts are integrally molded with said side panel of said light unit.

4. The under-cabinet light and outlet strip of claim 1, further comprising: a plurality of mounting ears directly affixed to adjacent end panels of said light and outlet units for receiving corresponding fasteners therethrough to thereby undermount said light and outlet units to the cabinet, said mounting ears extending distally away from said ends and being registered coplanar to corresponding bottom panel portions of said light and outlet units respectively.

5. An under-cabinet light and outlet strip for illuminating a surface area disposed below a cabinet, said under-cabinet light and outlet strip comprising:

a portable light unit having a light source housed therein;

a portable outlet unit removably conjoined directly to said light unit in such a manner that respective adjacent side panels of said light and outlet units are contiguously and linearly engaged;

first and second male receptacles located along end panels of said light and outlet units respectively;

a female receptacle located along said end panel of said outlet unit and positioned adjacent to said first male receptacle respectively;

a ground fault interrupt circuit electrically coupled in series to said second male receptacle and said female receptacle of said outlet unit respectively;

a linking cord having opposed male and female plugs removably and electrically coupled directly to said female receptacle of said outlet unit and said first male receptacle respectively;

a power cord having a female plug directly and removably coupled to said second male receptacle and further having a male plug removably attachable to an external power supply source;

a duplex outlet mounted to a top surface of said outlet unit and electrically coupled directly to said ground fault interrupt circuit; and, a switch mounted to said light unit and being electrically coupled directly to said first male receptacle and said light source respectively;

wherein said second male receptacle is electrically coupled to said female receptacle and said ground fault interrupt circuit respectively; and, wherein said light and outlet units comprise: a plurality of posts and a plurality of sockets directly and removably engaged in such a manner that respective top surfaces and ends panels of said light and outlet units remain contiguously abutted in coplanar orientations respectively.

6. The under-cabinet light and outlet strip of claim 5, wherein said posts are coextensively and linearly shaped and are further provided with rounded distal noses, said posts being registered orthogonal to said side panel of said light unit and being linearly interfitted within said sockets.

7. The under-cabinet light and outlet strip of claim 6, wherein said posts are integrally molded with said side panel of said light unit.

8. The under-cabinet light and outlet strip of claim 5, further comprising: a plurality of mounting ears directly affixed to adjacent end panels of said light and outlet units for receiving corresponding fasteners therethrough to thereby undermount said light and outlet units to the cabinet, said mounting ears extending distally away from said ends and being registered coplanar to corresponding bottom panel portions of said light and outlet units respectively.

* * * * *